US007117566B1

(12) United States Patent
Ewing

(10) Patent No.: US 7,117,566 B1
(45) Date of Patent: Oct. 10, 2006

(54) MANUALLY RELEASABLE CLIP HOLDER

(76) Inventor: Stephan C. Ewing, 1820 Old Waterman Canyon Rd., San Bernadino, CA (US) 92404

( * ) Notice: Subject to any disclaimer, the term of this patent is extended or adjusted under 35 U.S.C. 154(b) by 143 days.

(21) Appl. No.: 10/802,242

(22) Filed: Mar. 16, 2004

(51) Int. Cl.
*A45F 45/02* (2006.01)
*A45F 45/00* (2006.01)

(52) U.S. Cl. ..... 24/3.12; 24/3.1

(58) Field of Classification Search ..... 24/3.1, 24/3.11, 3.7, 3.12, 662, 669, 677, 678; 224/191, 224/197, 199, 235, 236, 241, 242, 247, 248, 224/271, 272, 901, 904; 248/221.11, 222.11, 248/223.41, 225.11
See application file for complete search history.

(56) References Cited

U.S. PATENT DOCUMENTS 1,519,380 A * 12/1924 Kochanski ..... 24/669
1,980,678 A * 11/1934 Gordon ..... 24/643
2,995,792 A * 8/1961 Morton, Jr. ..... 24/573.11
4,757,927 A * 7/1988 Rutty ..... 224/673
5,026,016 A * 6/1991 Lisowski ..... 248/225.11
5,054,170 A * 10/1991 Otrusina ..... 24/669
5,201,858 A * 4/1993 Otrusina ..... 224/197
5,622,296 A * 4/1997 Pirhonen et al. ..... 224/197
6,233,788 B1 * 5/2001 Choy et al. ..... 24/669

* cited by examiner

*Primary Examiner*—Robert J. Sandy
*Assistant Examiner*—Ruth C. Rodriguez
(74) *Attorney, Agent, or Firm*—James F. Kirk

(57) ABSTRACT

A manually releasable clip holder for receiving, securely holding and manually releasing a serpentine clip has a substantially flat base-plate. An insert is coupled to the base-plate. The insert has an insert cover with a top edge that forms an insert channel over the base plate. A channel aperture is formed at the insert cover top edge. A flap is pivotally coupled to the base plate and has a bottom edge. A spring is coupled to provide a restoring force to return the flap to a predetermined restored position with the flap bottom edge positioned above and beyond the insert cover top edge and the channel aperture. The separation between the flap bottom edge in the restored position and the insert cover top edge forms a window to the channel aperture. The flap is displaced toward the base-plate in response to a light deflection force from a serpentine clip.

15 Claims, 15 Drawing Sheets

MANUALLY RELEASABLE CLIP HOLDER

FIELD OF THE INVENTION

This invention relates to the field of tool holders and more particularly to the field of holders for tape measures. The tool holder of interest is one that is worn on or attached or carried on a wearer's waist belt such as the carpenter's tool holder shown in U.S. Pat. No. 5,915,610 issued on Jun. 29, 1999 to Russell; Steven W. for a "Carpenter's Tool Holder".

BACKGROUND OF THE INVENTION

Tape measures that contain an extendable and flexible tape typically are housed in a metal or plastic housing that has an external clip that permits its owner to attach the tape measure to his/her tool belt, waist band or pocket lip. The users of such tape measures include carpenters, electricians, plumbers, handymen/women and other persons in the fields of construction and other forms of fabrication. Workers such as these have long had a need for a Manually Releasable Clip Holder that is worn on one's side that could positively hold a tape measure to prevent its loss and which would permit the smooth, easy release of the tape measure only in response to the manual one-handed grasp of the worker. The tape measure of interest is typically capable of extending a flexible tape to a distance from 0 to 35 feet. The external clip on such a tape measure is typically held on the side of the tape measure's housing with a screw, a rivet or is molded into the side of the housing. In the absence of a holder, the wearer places the clip over top edge of the belt, pants pocket, or waistband to position the tape measure at a convenient location on the side of the worker. As the worker moves from task to task on a job, there are repeated chances or encounters with objects capable of dislodging the tape measure from the waist of the user resulting in the possible loss or damage to the tape measure. In addition, there exists the possibility of serious injury or even death to fellow workers who happen to be in a position below a tape as it falls. The risk of injury extends to those who happen to be under a high ladder, a scissor-lift or who might be located at the base of a high structure such as a high-rise building. Eliminating the inadvertent loss of a tape measure also eliminates the loss of time on the job that is spent locating, recovering or finding a replacement.

Tape holders that are presently available or that are in the art have the disadvantage of requiring multiple and in some cases awkward user steps. Such user steps include tasks such as snapping and unsnapping a securing strap during removal and replacement, modification of the tape measure either during manufacture or as an aftermarket add-on. There are even some holders that do not positively hold the tape-measure. The above-noted problems, and others, are overcome in accordance with the subject invention Manually Releasable Clip Holder.

SUMMARY OF THE INVENTION

The Manually Releasable Clip Holder provides a solution to the problem of storing articles for convenient and fast easy recovery where the environment is congested, bouncing, vibrating, inverted, or under water, or absent a gravity field as in space and where the Holder is coupled to a man, animal or machine for transportation or for the static storage of a tool. Although shown as a holder for a tape measure, other articles could be adapted for storage, by coupling a serpentine clip to them. Such articles might reasonably include flashlights, drills, hammers, electronic devices, such as radios, weapons and ammunition magazines, to mention a few. Although shown in the drawings as worn on a belt, the Manually Releasable Clip Holder could be adapted and mounted to strap surfaces such as found on back packs, parachutes, space suits, or rigidly mounted to a surface on a single altitude vehicle, multi-altitude vehicle, or a surface or on under-water vehicle for the manual storage and retrieval of articles to which a serpentine clip is affixed.

The proposed Manually Releasable Clip Holder has been tested and works well with small as well as large tape measures including those with tape as having widths extending from 0.5 inches to as wide as 1¼ inches. The tape must have a serpentine clip as shown in FIG. 6 or its functional equivalent for best operation. The serpentine clip must have a mounting plate side coupled to the tape measure and a serpentine side. A screw is used to hold the mounting plate side to the tape body. The serpentine clip also may have protruding channels to reduce friction and binding. The tip of the clip is bent to form a toe end. The toe end has a distal tip that enters the window between the flap bottom edge and the insert cover top edge.

In a first embodiment of the manually releasable clip holder, the manually releasable clip holder has a body that has a base-plate positioned between a left sidewall and right sidewall. The base-plate is substantially rectangular and has a top end, a bottom end, and a longitudinal axis that passes between the left sidewall and the right sidewall. The left and right side wall extend vertically from the base-plate.

An insert is coupled to the body between or over the left and right side walls. The insert has an insert left and right side wall coupled to the body. The insert left and right side walls support an insert cover that is positioned between the insert left sidewall and insert right sidewall. The insert cover has an outer surface and an inner surface. The insert cover inner surface faces the base-plate. The insert cover has a top edge and a bottom edge. The insert left sidewall, insert right sidewall and insert cover inner surface form an insert channel that has a channel aperture. The insert cover top edge forms a portion of the perimeter of the insert channel aperture. The insert cover outer surface is depicted as flat in the drawings; however, if use is contemplated with a tape measure that has a rubber case, the outer surface of the insert cover can be formed to have vertically positioned ridges or guides aligned to be substantially parallel with the central axis of the insert channel. The ridges would number at least two and they could be arrayed on the outer surface of the insert cover. The ridges would be formed to reduce the friction obtained from the rubber on the tape measure case in the region of the serpentine clip as the tape measure was being captured by the invention manually releasable clip holder.

A flap is formed from suitable material that has a top edge, a bottom edge, a left edge, a right edge and a longitudinal axis parallel to the longitudinal axis of the base plate. The flap is pivotally coupled on a pivot axis to the body. The pivot axis is positioned to place the flap bottom edge above the insert channel top edge.

A spring is coupled to the body and to the flap to restore the flap to a restored position with the bottom edge positioned above the channel aperture. A separation is provided between the flap bottom edge in the restored position and the insert cover top edge that forms a window that leads to the channel aperture.

The travel of the flap beyond the outer surface of the insert cover is limited by a travel limit means for limiting the pivotal travel of the flap. The flap bottom edge is stopped a predetermined distance beyond the insert cover outer surface.

In a second embodiment, the means of pivoting the flap is provided by flap flanges that extend outward beyond the upper left and right edges of the flap into left and right flap apertures formed in respective left and right sidewalls. Another means of pivoting the flap (not shown) involves positioning one or more protruding flanges above the top edge of the flap. This flange or these flanges are then received by corresponding apertures in the upper end of the body forming an alternate pivot arrangement. Another means of pivoting involves forming a receiving fold in the base and positioning the flap top edge into the receiving fold to form a pivot axis. It should be noted that there are many other commonly known means of forming a pivot and that the inventor prefers not to be limited solely by the means mentioned herein.

In the second embodiment, the manually releasable clip holder uses an integral and homogenous combination of the spring and flap formed from a single sheet of thin walled spring material. The combination base, spring and flap have a top region formed to provide a flap with a bottom edge, a left end and a right end. A bottom region of the base is used to form a base-plate that has a right end and a left end. A left spring leg region and a right spring leg region form a left and right spring leg. The left and right spring legs extend from the base-plate left end and right end to corresponding flap bottom edge left end and right ends. An insert is coupled to the base plate as in the first embodiment. A flap travel limit means is provided to limit the pivotal travel of the flap and to stop the insert cover bottom edge at a restored limit position protruding a predetermined distance beyond the insert cover outer surface.

In a third embodiment of the manually releasable clip holder, the body the body base-plate has an extended region shaped and bent at a base-plate top-end to form a shoulder. The shoulder leads to a further extended base-plate region shaped to form a flap with a flap bottom edge away from the shoulder. The shoulder is formed to position the flap above the base-plate. The flap bottom edge is positioned above the insert cover top edge to form a window to the channel aperture. The flap shoulder material is shaped to allow the flap to be displaced toward the base-plate in response to a light manual force applied to the flap or in response to a light deflection force from a serpentine clip pressing against the flap to admit the clip into the insert channe. The shoulder functions as a spring between the base-plate and the flap to provide a restoring force to return the flap to its predetermined restored position with a separation between the flap bottom edge in the restored position and the insert cover top edge. The third embodiment also has a means for limiting the distance that the flap bottom edge moves beyond the outer surface of the insert.

In a fourth embodiment of the manually releasable clip holder, the flap and spring are combined into a single integral and homogenous component. The flap has a bottom edge and a first region that extends away from the flap bottom edge to a top shoulder. The top shoulder is bent to direct a foot flange region or area of the flap metal back in the direction of the base plate bottom end. The foot flange region extends and terminates in a hook shoulder. The hook shoulder is bent and leads to a hook flange region. The hook flange region extends toward the base plate top end and terminates.

The body base-plate has a base aperture positioned above the flap lower edge. The flap first region, the top shoulder, the foot flange region, the hook shoulder and hook flange are formed to permit the hook flange to be inserted through the base aperture. Each region and shoulder is formed and coupled to the base plate to position the flap lower edge above the insert cover top edge forming a window to the channel aperture. The flap is displaced toward the base-plate in response to a light manual force or in response to a light deflection force from a serpentine clip to admit the clip into the insert channel via the insert aperture.

The top shoulder, foot flange, hook shoulder and hook flange functioning as a spring between the base-plate and the flap to provide a restoring force to return the flap region to a predetermined restored position with a separation between the flap bottom edge in the restored position, the insert cover top edge and the outer surface of the insert cover. A means for limiting the distance that the flap bottom edge moves beyond the outer surface of the insert cover comprises a flap that is formed to have a left and right travel limit flange. The body left sidewall and right sidewall are formed to have corresponding left and right travel limit apertures. The flap left and right travel limit flanges are positioned in the body's corresponding left and right travel limit apertures. The left and right travel limit apertures limit the range of movement of the left and right travel limit flanges.

BRIEF DESCRIPTION OF THE DRAWINGS

FIG. 8*l* is a bottom edge view of the combination of FIG. 8*j* with the insert in place;

DETAILED DESCRIPTION OF PREFERRED EMBODIMENTS

Figure 1:
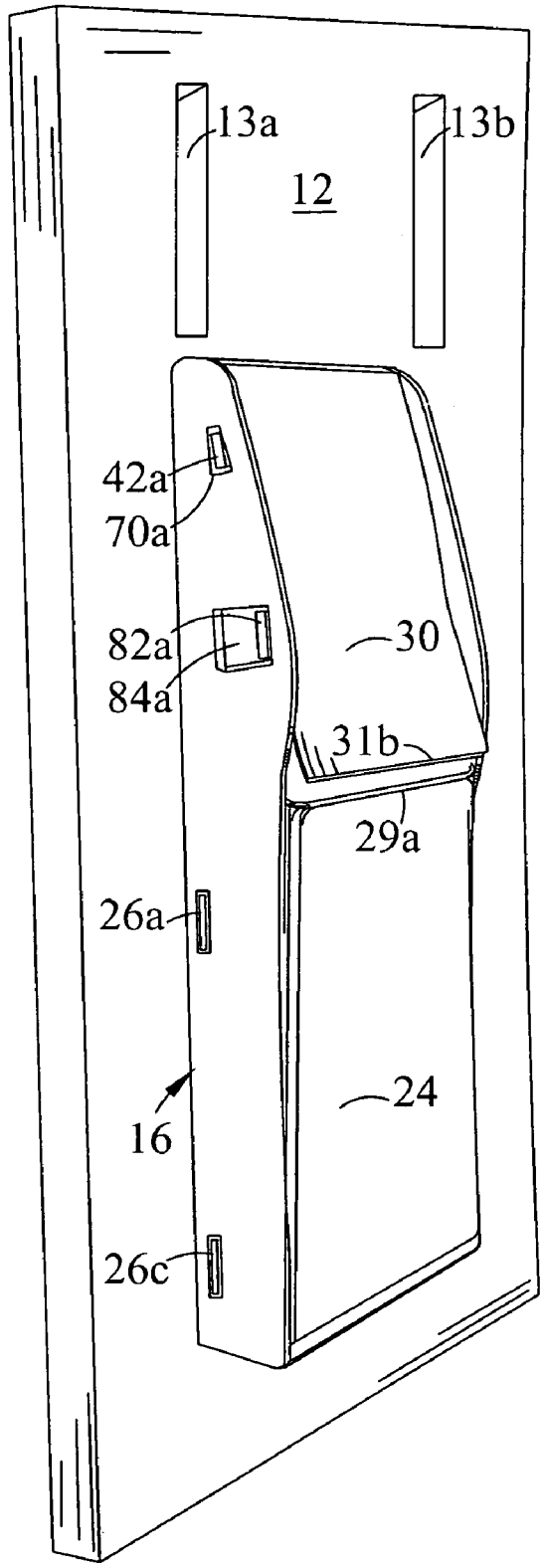
FIG. 1 is a perspective view of a first embodiment of the Manually Releasable Clip Tool Holder.

Details of the invention and of the preferred embodiments will now be presented with reference to the drawing. Beginning with FIG. 1, this Figure shows a first embodiment of the Manually Releasable Clip Holder 10 mounted on a leather pad 12 with belt loop holes 13*a*, 13*b* through which a belt (not shown) can be passed and worn by a person to carry the Manually Releasable Clip Holder 10 with comfort.

Figure 5A:
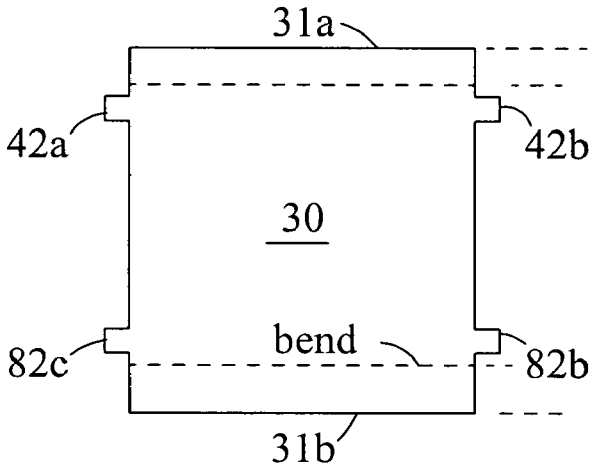
FIG. 5*a* is a plan view of a flap used the embodiment of FIG. 1.
Figure 5B:
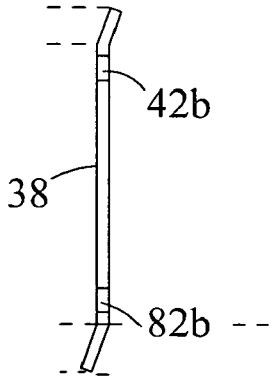
FIG. 5*b* is a right side view of a flap used the embodiment of FIG. 1
Figure 6:
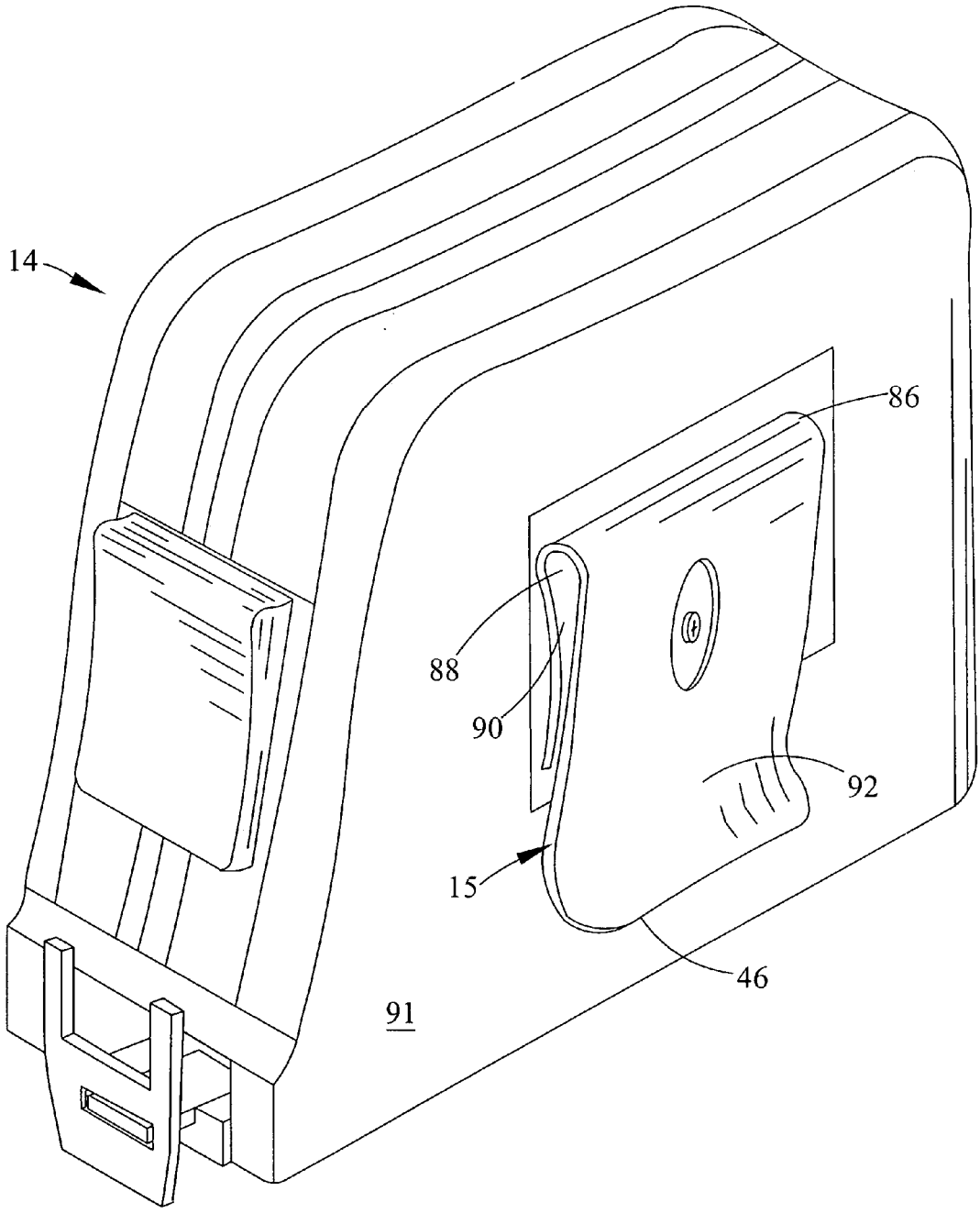
FIG. 6 is a perspective view of a typical tape measure with a serpentine clip on its right side when viewed from the front.

The first embodiment of FIG. 1 and its fabrication will be described in connection with FIGS. 2*a*–2*b*, 3*a*–3*d*, 4*a*–4*e*, and FIG. 5. The Manually Releasable Clip Holder 10 provides the function of receiving and holding a tape measure 14 such as shown in FIG. 6 that is equipped with a serpentine clip 15 until the wearer of the belt manually releases and removes the tape measure from the Manually Releasable Clip Holder 10.

Figure 2A:
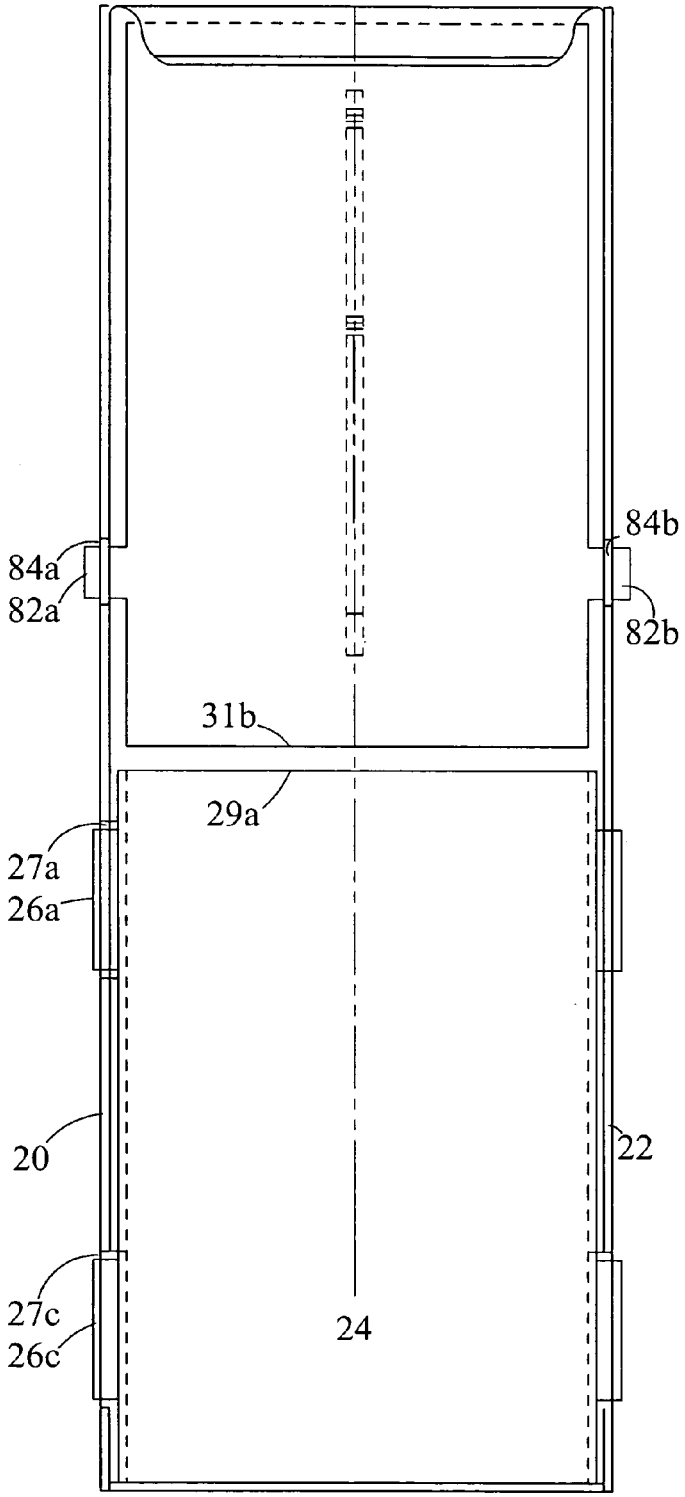
FIG. 2*a* is a plan view of the first embodiment of the Manually Releasable Clip Holder of FIG. 1.
Figure 2B:
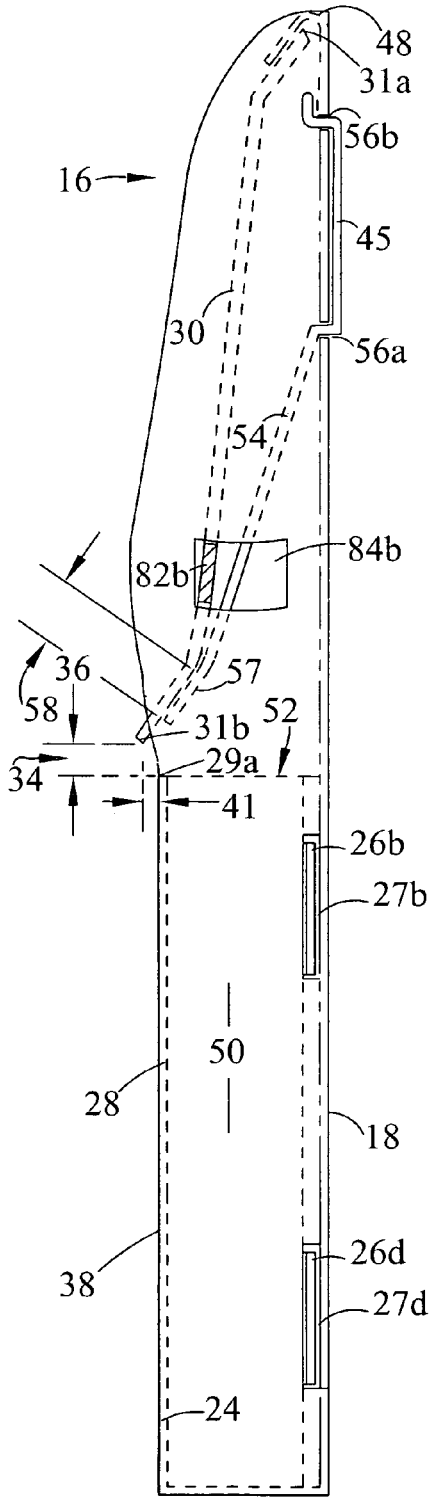
FIG. 2*b* is a a right side view of the first embodiment of the Manually Releasable Clip Holder of FIG. 1.

FIGS. 2*a* and 2*b* show the essential features of the first embodiment of the Manually Releasable Clip Holder of FIG. 1. The body 16 is formed from thin walled material such as sheet metal. The body 16 might also be formed or molded or extruded or cast from plastic. The body 16 has a base 18, a left sidewall 20 and a right side wall 22. An insert 24 is located between the left sidewall 20 and the right sidewall 22. The insert 24 is also formed from sheet metal or from plastic. The insert 24 is coupled to the base by four insert flanges 26*a*–26*d* which pass through four receiving body flange slots 27*a*–27*d* that are stamped or cut through the body 16 above the base 18. The portion of the insert cover above base 18 and between the left sidewall 20 and the right sidewall 22 is the insert cover 28. The insert cover has an insert cover top edge 29*a* and an insert cover bottom edge 29*b*. Flap 30 has a flap top edge 31*a* and a flap bottom edge 31*b*. The flap bottom edge 31*b* is on a portion of Flap 30 that extends toward the insert channel 50 from the pivot axis at the Flap Top Axis 31*a*. The gap between the insert cover top edge 29*a* and the flap bottom edge 31*b* is a clearance window 34. The clearance window 34 has a clearance window height 36 that is typically in the range of 0.090 to 0.250 inches. The height of the window is determined empirically where larger or smaller than normal serpentine clips are to be used. The height of the window could also be based on the best height for a sample of most common tape measures.

FIG. 2*b* also shows that the flap bottom edge 31*b* is positioned to the left of the insert cover outer surface 38. The distance between the flap bottom edge 31*b* and the insert cover outer surface is the insert cover outer surface to flap bottom edge clearance distance 41 which must be greater than zero to insure that the flap will continue to engage the serpentine clip while being vibrated. The insert cover outer surface to flap bottom edge clearance distance 41 is typically in the range of 0.075 to 0.125 inches. Tests have shown that if the insert cover outer surface to flap bottom edge clearance distance 41 is too small, or less than zero, as the Manually Releasable Clip Holder is subjected to vibration, the serpentine clip 15 shown on the tape measure in FIG. 6, will vibrate back past the flap bottom edge 31*b* allowing the tape to escape. The window height 36 distance and the insert cover outer surface to flap bottom edge clearance distance 41 are inter-related. As the window height 36 is increased, distance 41 must also be increased. Increasing the window height 36 typically results in easier removal and replacement of the tape measure. In turn, the larger the insert cover outer surface to flap bottom edge clearance distance 41, the bulkier the holder becomes. The best mode is obtained by empirically adjusting the window height distances 36 and the insert cover outer surface to flap bottom edge clearance distance 41 to obtain the smallest profile, while providing actual and tested ease of use for the greatest number of available brands of tape measures.

Referring again to FIG. 1, flap 30 is shown pivoting on left flap pivot flange 42*a* which is held in the left side wall flap flange receiving hole 70*a*. Left and right flap pivot flanges 42*a* and 42*b* are also shown in FIG. 5*a*. The right flap pivot flange 42*b* is shown in FIGS. 5*a* and 5*b*. The combination of a flap pivot flange 42*a*, 42*b* in a flap flange receiving hole 70*a*, 70*b* is possibly the least expensive pivot arrangement that can be made for pivoting the flap. If the receiving hole is made round instead of arched as in FIG. 1, cost would be lower but it would be reasonable to expect that wear on the edge of the flap pivot flange and on the edge of the corresponding flap flange receiving hole 70*a*, 70*b* would be increased. In each case, the size of the flange receiving hole would be adjusted to pass the respective flap pivot flange with a clearance that would permit the flap 30 to move with ease in response to a force of contact and engagement with the toe end 46 of the serpentine clip 15 as depicted in FIG. 7*b*. The combination of a receiving fold 48 with the flap top edge 31*a* to form a pivot axis as in FIG. 2*b* is a combination that solves any wear problem associated with the flap pivot flanges 42*a*, 42*b* and the flap flange receiving hole 70*a*, 70*b*. It should be noted that there are many other commonly known means of forming a pivot and that the inventor prefers not to be limited solely by the means mentioned herein.

Referring to the embodiment of FIG. 1 the body left and right sidewalls 20, 22 are shown to be in parallel relation with each other, however these sidewalls can be shaped as a tapered channel along with the insert left and right wall 32*a*, 32*b* so as to form a funnel shape above the window to assist in guiding the serpentine clip into the window and then into the insert channel 50. A tapered arrangement (not shown) would assist the user with a blind insertion and engagement. The raised left and right sidewalls 20, 22 rise above the flap. The added height of the sidewalls above the flap is another aid to blind insertion. The combination of tapered and raised body sides affords a best combination for channeling the clip toe end 46 into the clearance window 36 and then into the insert channel aperture 52. The added height of the side walls 20, 22 above the outer surface of the flap 30 should be in the range of 0.1 to 0.165 inches. As described above, the flap bottom edge 31*b* is formed outward to position the tip of the flap bottom edge 31*b* above the top edge of the insert cover top edge 29*a*, the height of the window 36, a distance of about 0.1 inch.

Referring again to FIG. 2*b*, spring 54 is a wire spring that is formed from spring steel to have three right angle bends as it passes through slots 56*a*, extending along spring base end 45 to slot 56*b* terminating in a final right angle bend on the inner surface of base 18. The spring 54 has a tang end 57 with a tang reach 58. If formed with a sufficient bend angle as shown, the spring tang end 57 will urge the flap top end into the receiving fold 48. The tang reach 58 must be of a length sufficient to prevent to fold in the flap sliding over the tang reach. As an alternative, a coil spring could be substituted for the wire spring 54. The coil spring (not shown) could be mounted by forming a hole in the base 18 to receive a first 90 degree bent end of the coil spring. In the alternative, the base could be slightly dimpled to receive the first end or coil of the spring. The flap could be dimpled outward to form a recess into which the second end of the coil spring could be inserted. The outward dimple could have a center inward dimple resulting in the formation of a recess ring in the flap and base, which would serve to register and hold the coil spring at a predetermined location. A coil spring has the advantage of being low in cost and widely available from suppliers.

In the embodiments of FIGS. 8*a*–8*l* and FIGS. 9*a*–9*d* the flap is combined with the base 18 by forming and bending a single homogeneous sheet of sheet metal having sufficient resilience, or that is tempered after forming, to provide a reliable spring restoring force to the flap. In the fourth embodiment of FIGS. 10*a* and 10*b*, a portion of the flap is used to form the spring. In each of these embodiments, spring function is provided by the resilience of the metal at the flexure formed at the bend in the sheet metal. In each of these embodiments, selection of the sheet material and the design of the pattern for the flap and base or the design of the flap and the hook for the fourth embodiment of FIGS. 10*a* and 10*b*, in combination is executed in a design that insures that Flexing the flap through its maximum flex range does not result in the stress on the metal in the region forming the spring bend exceeding the elastic or plastic limit of the material therein. In addition to the alternatives shown for a spring, another alternative is the use of a a torsion spring formed from a rod having a torsion pre-stress with a first end coupled to the flap and a second end coupled to the base. The pre-stress is adjusted to provide a predetermined torque as the flap reaches its fully restored position, the torque increasing as the flap is deflected inward.

Figure 3A:
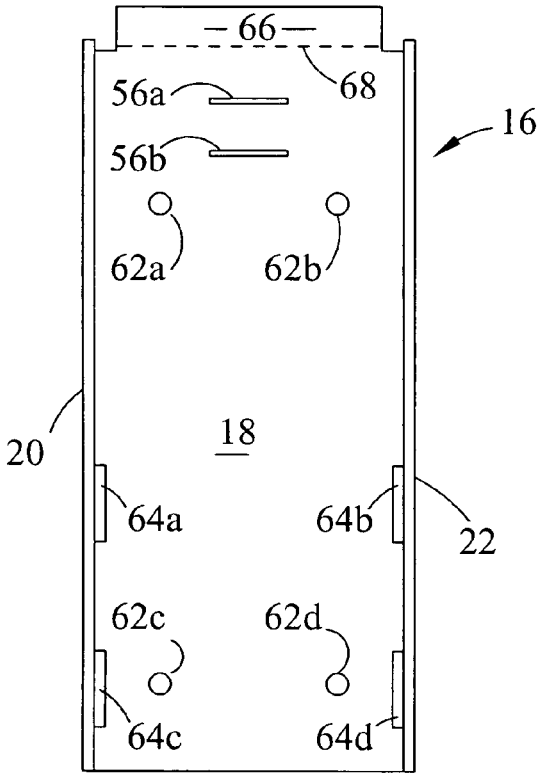
FIGS. 3*a*–3*d* show the sheet metal development of the body used in the first embodiment, showing an alternative means of coupling the insert to the body of the Manually Releasable Clip Holder with insert flanges passing through the base in FIG. 3*d;*
Figure 3B:
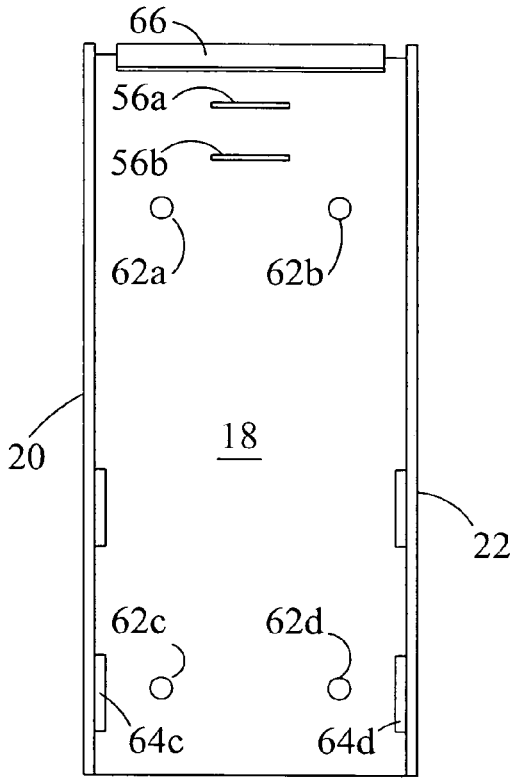

FIG. 3*a* is a top plan view of the body 16 formed from sheet metal or other material of suitable strength. Four base holes 62*a*–62*d* are stamped in the base 18 so that the base can be riveted or bolted to the leather pad 12. Four insert mounting flange slots 64*a* –64*d* are provided to receive four insert mounting flanges. FIG. 3*a* shows the body left and body right side walls 20, 22 formed into their vertical and parallel positions above base 18 but before the receiving fold 48 is formed by bending the body top tab area 66 along the body fold line 68. The body left and right side walls 20, 22 are viewed on edge. FIG. 3*b* shows the receiving fold 48 formed to receive the flap top edge 31*a*. Top and bottom spring body base slots 56*a*, 56*b* are shown formed in the base 18

The flap pivot arrangement of FIGS. 2*a* and 2*b* in which the flap top edge 31*a* is inserted into a receiving fold 48 is only one embodiment of many that are possible for pivoting the flap 30. FIGS. 1, 5*a* and 5*b* show flap pivot flanges 42*a*, 42*b* formed on the left and right edge of the flap close to or at the flap top edge 31*a*. Left and right side wall receiving holes 70*a*, 70*b* are formed in the left sidewall 20 and a right side wall 22. The left sidewall 20 and a right side wall 22 are then sprung open to receive the flap pivot flanges 42*a*, 42*b*. Another alternative pivot arrangement is the use of a rod for an axel (not shown) extending through the left and right sidewall receiving holes 70*a*, 70*b*. The flap 30 is coupled to the rod using a spot weld, solder, screws, rivets, or structural epoxy. In the alternative, the flap could be partially stamped through to form hangar rings or hooks through which the rod could pass. Another alternative arrangement is the use of flexible webbing such as impregnated fiberglass or flex material such as Kapton (not shown) bonded or coupled mechanically between the flap top edge 31*a* and the base 18.

Figure 3C:
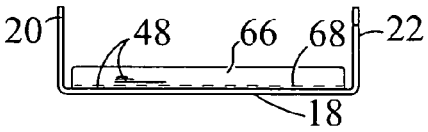

FIG. 3*c* is a bottom or end view of the body 16 after the body top tab area 66 is folded along body fold line 68 to form the receiving fold 48. The bottom edge of the left sidewall 20 and the right sidewall 22 are shown separated by base 18. Receiving fold 48 is along a horizontal line in the background on the top surface of base 18.

Figure 3D:
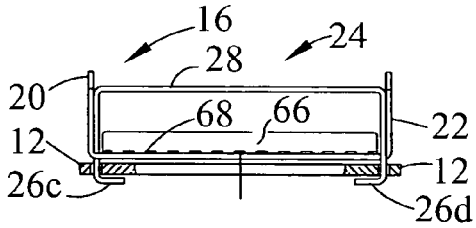

FIG. 3*d* schematically shows the bottom or end view of the body 16 of FIG. 3*c* with insert 24 snapped into position in the body 16 to form an insert channel 50 for receiving the serpentine clip 15 (not shown). The insert 24 is shown coupled to the body by insert flanges 26*a*–26*d* that penetrate slots in the body sidewalls as shown in FIG. 2*b* or by passing through insert mounting flange slots 64*a*–64*d* in the base 18 as shown in FIG. 3*a*. FIG. 3*d* shows insert flanges 26*c* and 26*d* passing through slots in leather pad 12 before being bent or folded toward the center of the base.

Figure 4A:
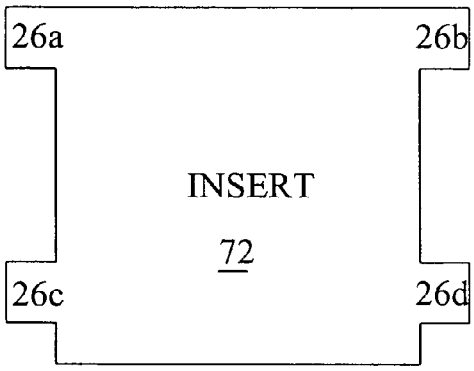
FIGS. 4*a*–4*e* show the sheet metal development of the insert used in the first embodiment of the Manually Releasable Clip Holder.
Figure 4B:
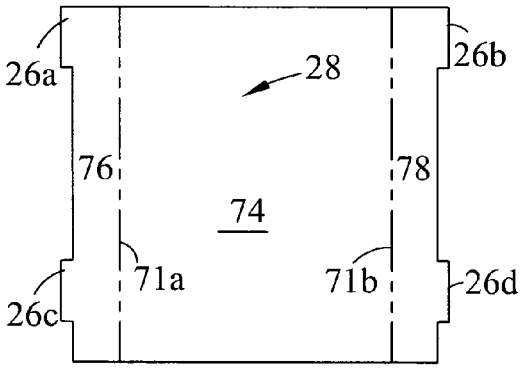

FIGS. 4*a*–4*e* show the development of the insert 24 and the insert flanges 26*c* and 26*d* from thin walled material pattern such as the sheet metal pattern 72. Insert flanges 26*a*–26*d* are formed from the four flange areas 102*a*–102*d*. FIG. 4*b* shows the sheet metal pattern 72 has three principal areas that include an insert cover area 74 which will form insert cover 28, an insert left wall area 76 and an insert right wall area 78. Phantom lines 71*a* and 71*b* show where the sheet metal pattern is bent to form the insert flanges 26*a*, 26*b*. In the embodiment of FIG. 1 and FIG. 2*b*, insert flanges 26*a*–26*d* are shortened and formed to pass through receiving body flange slots 26*a* –26*d*. as FIG. 4*b* shows the four flange areas 102*a*–102*d* shortened to a predetermined length to fit into the four receiving body flange slots 27*a*–27*d* that are stamped or cut through the body 16 above the base 18. The embodiment of passing the insert flanges 26*a*–26*d* through the base 18 and folding them over the leather pad 12 as shown in FIG. 3*d* instead of passing them through the body left and right sidewalls 20, 22 via receiving body flange slots 27*a*–27*d* eliminates the necessity of attaching the body 16 to the leather pad 12 using rivets or other coupling means.

Figure 4C:
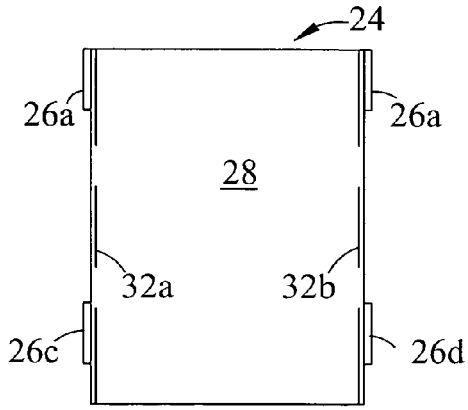

FIG. 4*c* shows the sheet metal pattern 72 after the insert left wall area 76 and insert right wall area 78 are bent 90 degrees to form the insert left wall 32*a* and the insert right wall 32*b*. Flange areas are bent 90 degrees in a rotational direction opposite to the bend direction used to form the insert left wall 32*a* and the insert right wall 32*b*. The insert flanges 26*a*–26*d* extend outward from the lower edge of the insert left wall 32*a* and the insert right wall 32*b*. When formed, insert 24 provides an insert channel 50 under the insert cover 28.

Figure 4D:
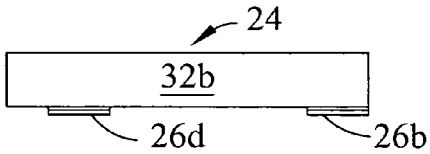
Figure 4E:
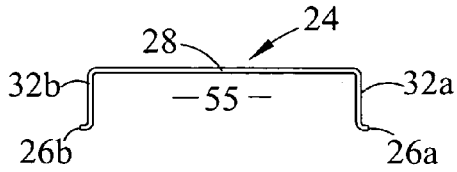

FIG. 4*d* shows the insert right wall 32*b* and shortened insert flanges 26*d* and 26*b* at the bottom of the insert right wall 32*b*. FIG. 4*e* is a top end view of insert 24 that shows the top edges of insert left wall 32*a*, insert right wall 32*b*, and the insert cover 28 shaped to form the insert channel 50.

FIGS. 5*a* and 5*b* show a plan view and side view of the flap 30 with flap pivot tabs 42*a*, 42*b*. Flap pivot tabs are not required in an embodiment such as shown in FIG. 2*b* using a receiving fold 48. FIG. 1 shows pivot tab 42*a* passing through a left flap flange receiving hole 70*a* as an alternative to the pivot means shown in FIG. 2*b* and FIGS. 3*a*–3*d* of bending a body top flange area 66 along the body fold line 68 through an angle greater than 110 degrees to form the receiving fold 48 to rotationally support and hold the flap top edge 31*a*. As shown in FIGS. 1 and 2*b*, left and right travel limit flanges 82*a*, 82*b* extend through the left and right travel limit apertures 84*a*, 84*b* to limit the pivot range through which the flap 30 moves.

FIG. 6 shows a typical retractable tape measure 14 with a serpentine clip 15 coupled to the right side of the retractable tape measure housing 91. The serpentine clip 15 is formed from a homogeneous length of material, such as sheet steel or spring steel or spring brass. The homogeneous length of material is bent at a shoulder 86 to form a serpentine clip channel 88 that separates a mounting plate side 90 that extends downward from shoulder 86 and that is coupled to the right side of the retractable tape measure housing 91. The clip also has a serpentine side 92 that extends downward from the shoulder 86 to terminate at a toe end 46. The mounting plate side 90 and the serpentine side 92 are separated by the shoulder 86 at the top of the serpentine clip. The mounting plate side 90 and the serpentine side 92 are typically formed to contact each other due to spring action just above the toe end 46.

The mounting plate side 90 is typically coupled to the right side of the retractable tape measure housing 91 with a screw (not shown). In some combinations, the mounting plate side 90 is molded into a plastic cavity, spot welded, riveted or bonded to the housing using a structural adhesive.

Figure 7A:
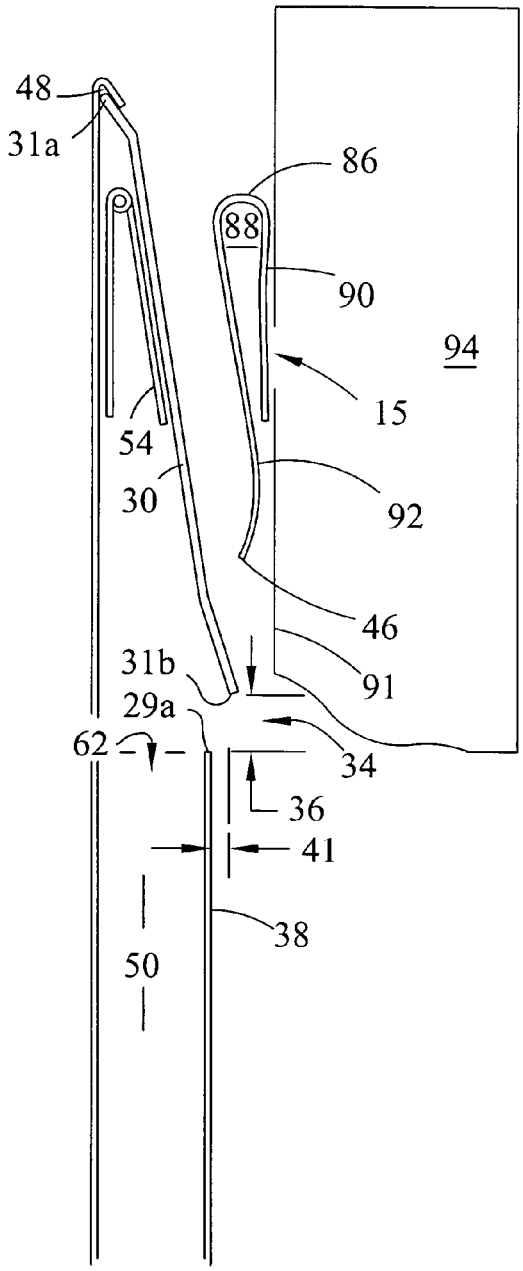
FIGS. 7*a*–7*d* are a set of four schematic side sectional views of a first embodiment of the Manually Releasable Clip Holder showing the contact, gradual displacement and restoration of the flap in response to an advance of a serpentine clip.
Figure 7B:
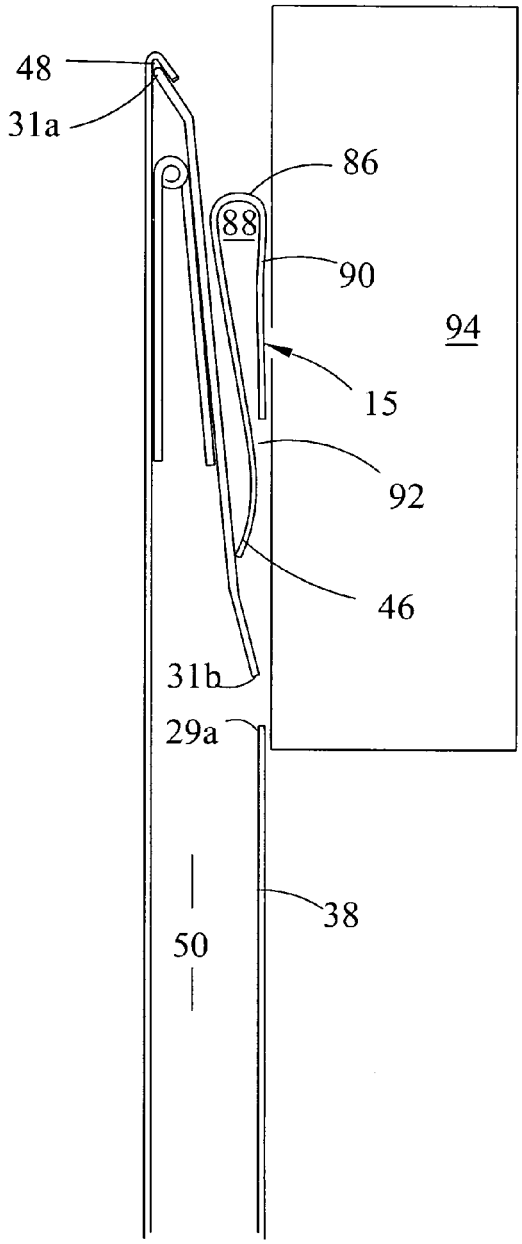

FIGS. 7*a* and 7*b* are intended to schematically illustrate the operation of the Manually Releasable Clip Holder 10 in a sequence of steps in which a serpentine clip 15 is aligned with and eventually inserted into the Manually Releasable Clip Holder. FIG. 7*a* shows the serpentine clip 15 from its rear edge coupled to the right side of block 94. Block 94 is used to schematically represent the retractable tape measure 14, or housing 91, or, in the alternative, other items adapted for and similarly equipped with a serpentine clip. Such items might include items such as weapons; including knives, guns, grenades, gas cylinders, magazines, explosives, or portable tool items such as hammers, knives, drills, axes, saws, levels, instruments such as binoculars, cell phones, computers, GPS navigational aids, or portable radios to name a few. A serpentine clip 15 is attached to each such item for use with an adaptation of one of several embodiments presented herein of the Manually Releasable Clip Holder 10.

Block 94 is shown approaching the Manually Releasable Clip Holder 10 for insertion of the serpentine clip 15. The serpentine side 92 is shown above the flap bottom edge 3*b*. The gap between the flap bottom edge 31*b* and inset cover top edge 29*a* is the clearance window 34. As block 94 moves closer to the flap, the distance between the toe end 46 of the serpentine side 92 of the serpentine clip 15 and the outer surface of the flap 30 is reduced.

FIG. 7*b* shows the toe end 46 contacting the flap 30 as block 94 continues its move to the left. Flap 30, pivots around the flap top edge 31*a* residing in the receiving fold 48. The lower surface of block 94 contacts the insert cover outer surface 38. As shown in FIG. 7*b*, the length of the flap 30 and the position of the pivot axis in receiving fold 48 is predetermined to establish a window height 36 between the flap bottom edge 31*b* and the insert channel top edge 29*a*. Entry into the insert channel 50 is through an insert channel aperture 52 via clearance window 34 at the top of the insert channel 50. Entry to the insert channel aperture 52 is obtained by pivoting the flap from its restored position through an angle of rotation sufficient to expose the insert channel aperture 52 to passage of the toe end 46 of the serpentine clip. Spring 54 is compressed by movement of the flap and provides a continuous restoring force via spring tang end to return flap 30 to its restored position.

Figure 7C:
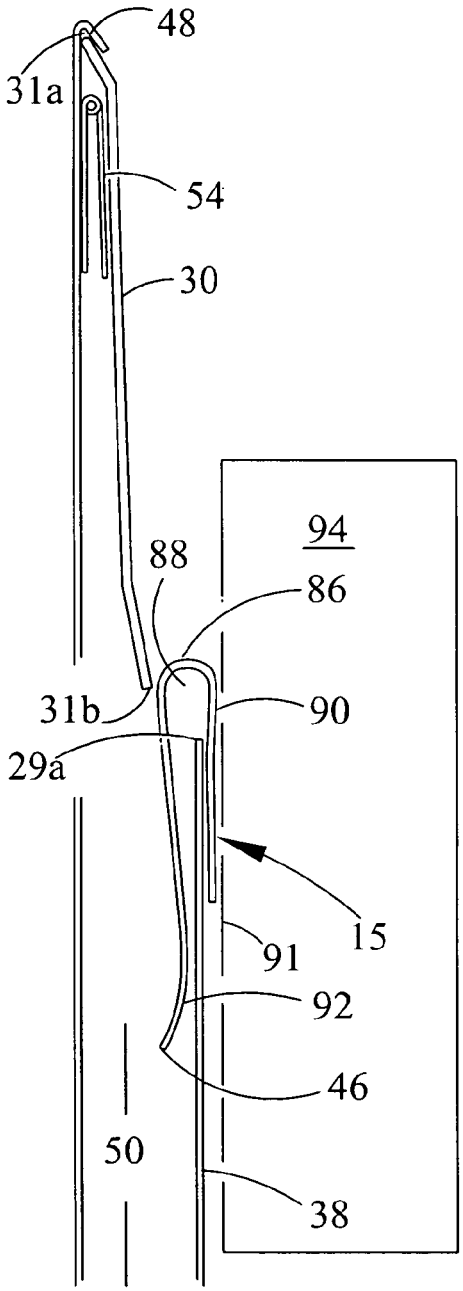

FIG. 7*c* is obtained from 7*b* by pushing block 94 downward while holding the left surface of block 94 against the insert cover outer surface 38. As the serpentine clip 15 is moved downward with pressure applied to urge movement to the left, the toe end 46 displaces the flap to the left thereby exposing and entering the insert channel 50. The insert channel top edge 29*a* moves into the serpentine clip channel 88 as engagement progresses. With further movement, block 94 drives downward. The toe end 46 of the serpentine side 92 continues movement into insert channel 50 via insert channel aperture 52 at the top of the insert channel 50. In FIG. 7*c*, the downward movement of block 94 is incomplete. The insert cover top edge 29*a* is not in contact with the bottom of the shoulder 86. The flap bottom edge 31*b* is sliding upward on the serpentine side 92 of the serpentine clip 15 with further downward movement of block 94. As shown, the flap bottom edge 31*b* is almost cresting the shoulder 86.

Figure 7D:
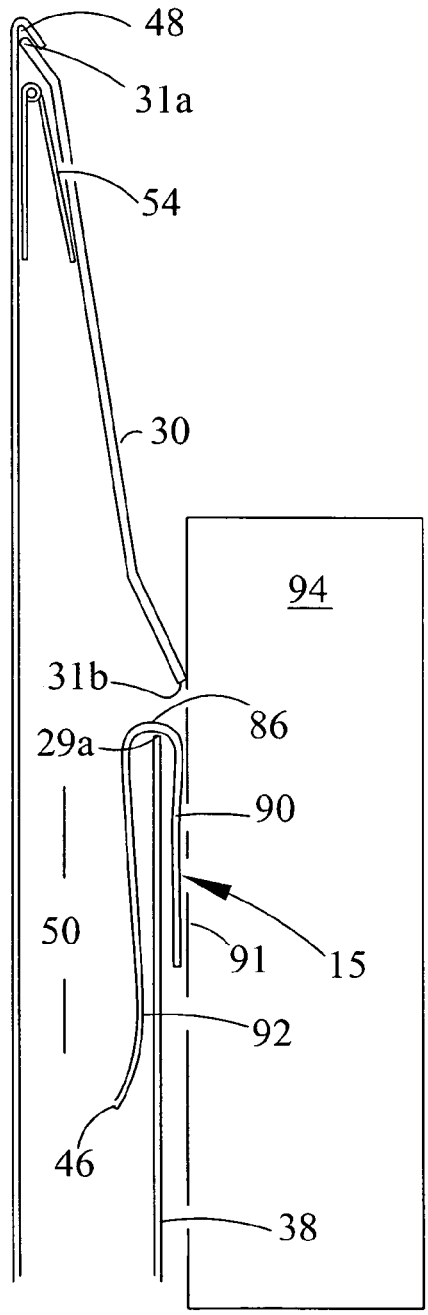

FIG. 7*d* shows that block 94 has been pushed downward to bring the insert cover top edge 29*a* into contact with the inner surface of shoulder 86 terminating further downward movement of block 94. The serpentine side 92 is fully positioned in the insert channel 50. The toe end 46 is not in contact with the bottom of the insert channel or any surface. The shoulder 86 extends through the widow 34. The clearance window 34 is large enough to provide a clearance between the shoulder 86 and the flap bottom edge 31*b*. The flap lower edge has cleared the shoulder 86 and spring 54 has applied sufficient force to return the flap to its restored position. The restoring motion of the flap has positioned the flap lower edge above the shoulder 86 and against the right side of tape measure housing 91 thereby preventing upward motion of the shoulder in the absence of a manual depression of the flap 30 to the left. The travel of the flap 30 to the right is limited by the right side of tape measure housing 91.

Ideally, the outward travel of flap bottom edge 31*b* is not limited by the left and right flanges 84*a*, 84*b* shown in FIG. 1 and FIG. 2*b* when the serpentine side of the clip 92 is fully inserted into the insert channel 50.

FIGS. 8*a*–8*l* and 9*a*–9*d* show separate embodiments in which each combines the function of the spring, shown in FIG. 2*b* as 54 and the flap 30 into a single integral and homogeneous component. The embodiments of the two are also distinguished by the flap being free of flap pivot flanges such as 42*a*, 42*b* and or the combination of the flap top edge 31*a* with a receiving fold 48. The embodiment of FIGS. 8*a*–8*l* is the only embodiment in which spring arms support the flap 30 from a base location below the insert channel aperture 37.

Figure 8A:
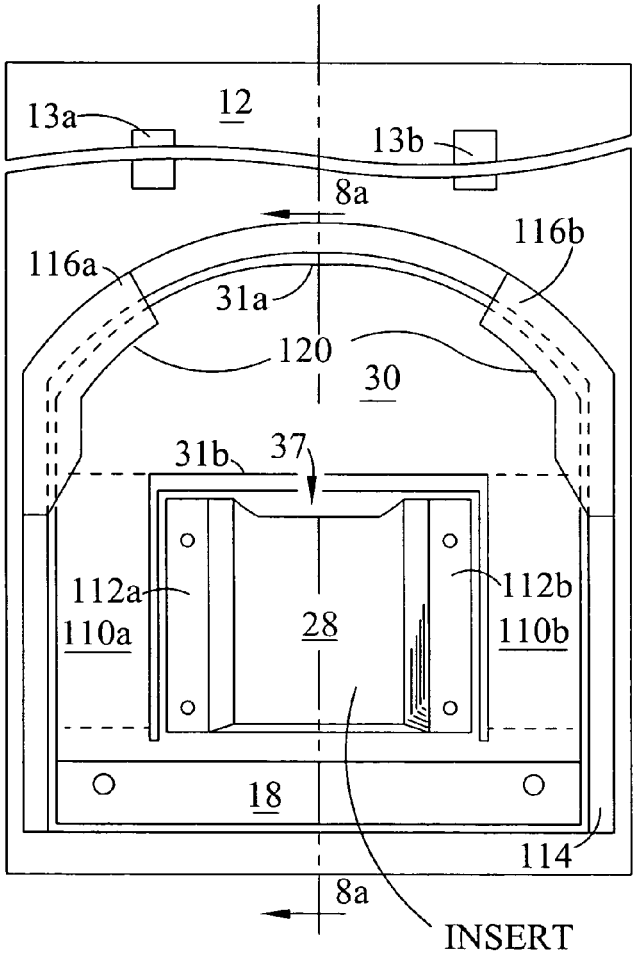
FIG. 8*a* is a plan view of a second embodiment of the Manually Releasable Clip Holder using a combination flap and spring supported from pivot points below the insert aperture.
Figure 8B:
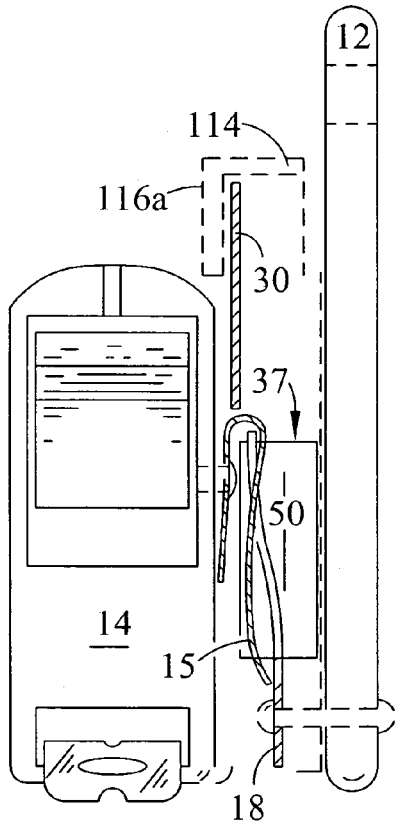
FIG. 8*b* is a schematic side sectional view of the serpentine clip in the insert channel of the second embodiment of FIG. 8*a;*

FIG. 8*a* shows the assembled embodiment which comprises an integral and homogeneous base 18, flap and left and right spring arm 110*a*, 110*b* coupling the base to the flap 30. FIG. 8*b* shows that the insert 28 has an insert channel 50. The insert 28 is coupled to the base 18. The insert channel aperture 37 provides an entrance into insert channel 50. Insert 28 is coupled to the base using the left and right mounting flanges 112*a*, 112*b*. Rivets, screws, or adhesive is used to couple the left and right mounting flanges to the base 18.

Figure 8C:
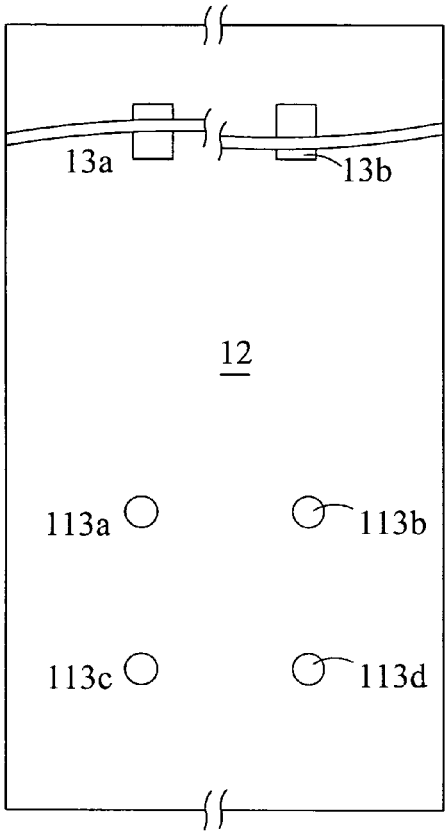
FIG. 8*c* is a plan view of the a leather pad with belt loops for mounting the Manually Releasable Clip of FIG. 8*a;*
Figure 8E:
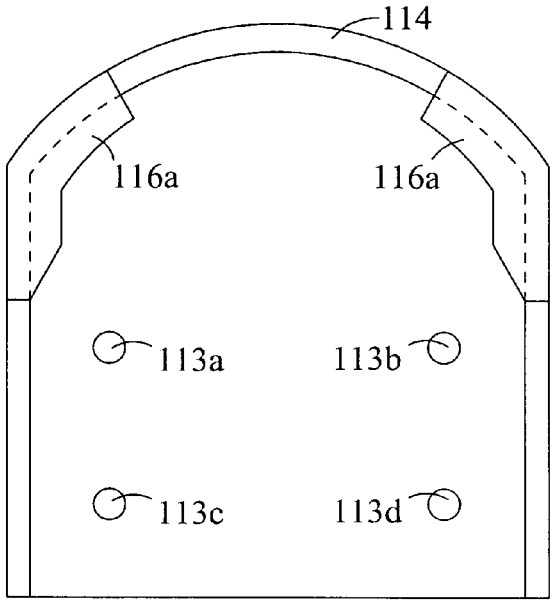
FIG. 8*e* is a plan view of the combination body and cap for the second embodiment of the Manually Releasable Clip Holder of FIG. 8*a;*
Figure 8F:
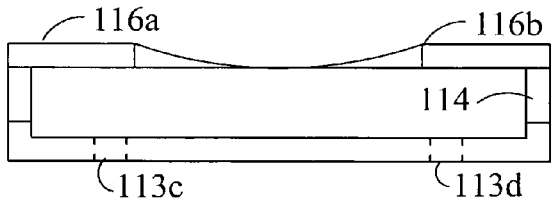
FIG. 8*f* is a bottom edge view of the combination body and cap for the Manually Releasable Clip of FIG. 8*a;*
Figure 8D:
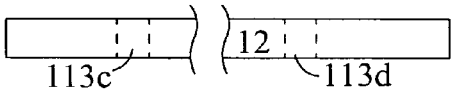
FIG. 8*d* is a bottom edge view of the a leather pad with belt loops for mounting the Manually Releasable Clip of FIG. 8*a;*
Figure 8G:
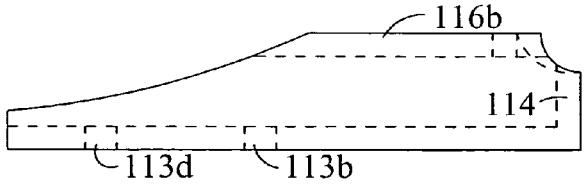
FIG. 8*g* is a side view of the combination body and cap for the Manually Releasable Clip of FIG. 8*a;*
Figure 8H:
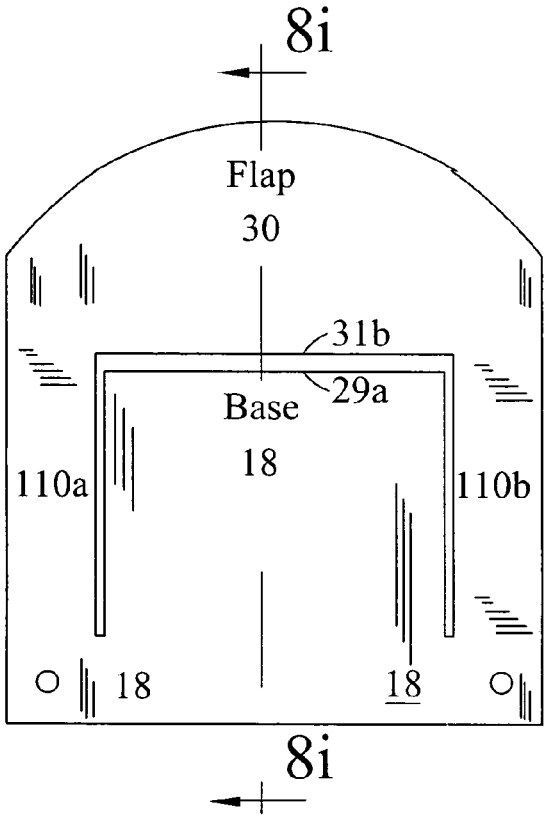
FIG. 8*h* is a plan view of the combined integral and homogeneous flap, base and spring used in the second embodiment of the Manually Releasable Clip Holder of FIG. 8*a;*

FIG. 8*b* also shows a tape measure 14 with serpentine clip 15 inserted into the insert channel 50. FIG. 8*c* shows the leather pad 12 with predrilled rivet holes 113*a* –113*d* and slots 13*a* and 13*b*. FIG. 13*d* is an edge view of the leather pad 12. FIG. 8*e* is a plan view of the body shell 114 with four rivet holes corresponding to those through the leather pad 12. Left and right body shell flanges 116*a* and 116*b* are shown. FIGS. 8*f* and 8*g* are front and side views of the body shell 114 shown in FIG. 8*e*. FIG. 8*h* is a plan view of the flap base spring element 118 that combines the function of the flap 30, the base 18 and the spring 54 functions into a single integral and homogeneous component. The spring function is provided by left and right spring arms 110*a* and '110*b*. The flap base spring element 118 is stamped out of spring steel.

Figure 8I:
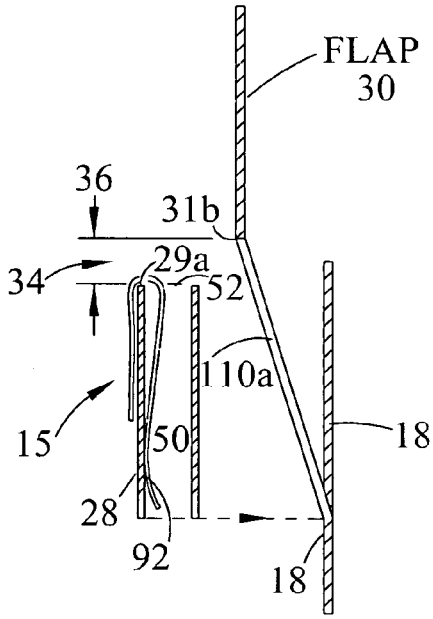
FIG. 8*i* is a schematic side sectional view of the combined flap and spring of FIG. 8*h* with a tape measure serpentine clip seated in the insert channel of the second embodiment of the Manually Releasable Clip Holder of FIG. 8*a;*

FIG. 8*i* is a schematic sectional view of shows the flap base spring element 118 shown in FIG. 8*h* taken on section line 8*i*–8*i* of FIG. 8*h*. The insert channel 50 has a top edge 29*a*. The flap has a flap top edge 31*a* and a flap bottom edge 31*b*. The flap bottom edge 31*b* is spaced apart and above the insert channel top edge 29*a* forming a window 34. The left and right spring arms have a length and are integrally and homogeneously coupled to the base 18 at a position below the flap bottom edge 31*b*. The position at which the left and right spring arms are coupled to the base 18 and the length of the left and right spring arms 110*a*, 110*b* are predetermined to position the flap bottom edge 31*b* at a window height 36 above the insert cover top edge 29*a*.

Figure 8J:
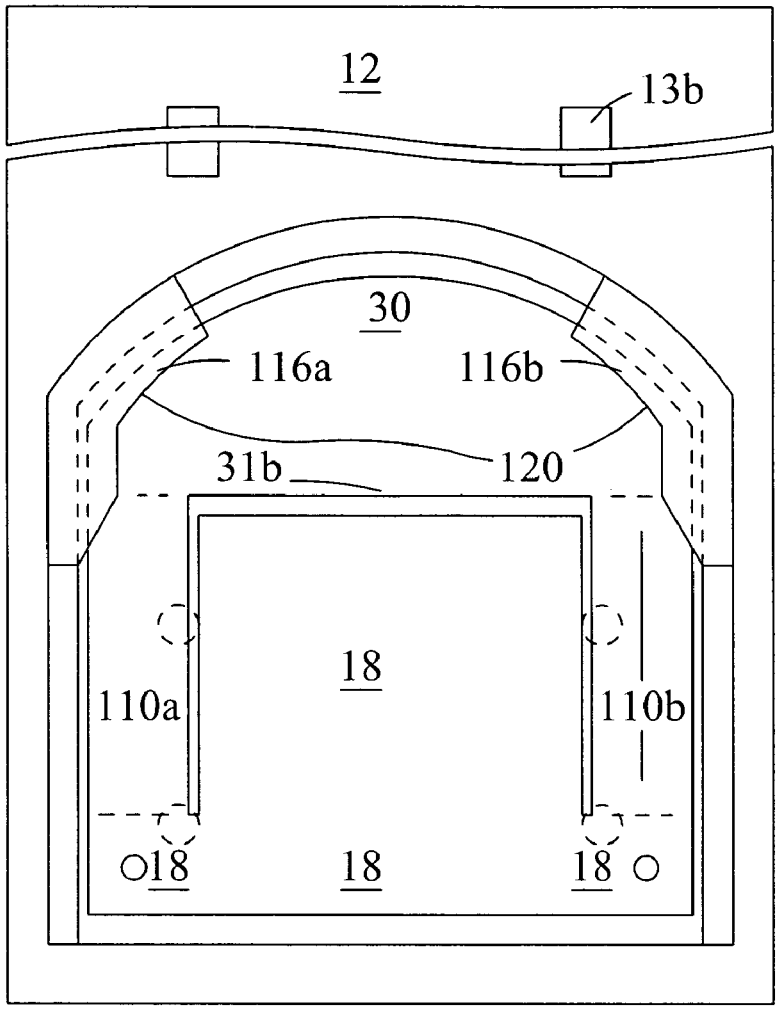
FIG. 8*j* is a plan view of the combination body and cap positioned on the leather pad of FIG. 8*c* with the combined flap and spring of FIGS. 8*h* and 8*i* positioned on the base of the combined body and cap.

FIG. 8*j* is a plan view showing the flap base spring element 118 on top of the body shell 114 which is on top of the leather pad 12. The base 18 is riveted or screwed or bolted to the base of the body shell 114, the fasteners such as rivets passing through the base 18 regions on the base, flap spring element 118 to the opposite side of the leather pad 12. The body shell flanges 116*a*, 116*b* limit the outward movement of the flap 30. The body shell 114 also has a cut-out or body shell opening 120 at the top and center of the body shell 114. The body shell opening 120 provides room for the thumb of the hands depressing the flap 30 through the body shell opening 120 to release the serpentine clip on the tape measure 14.

Figure 8K:
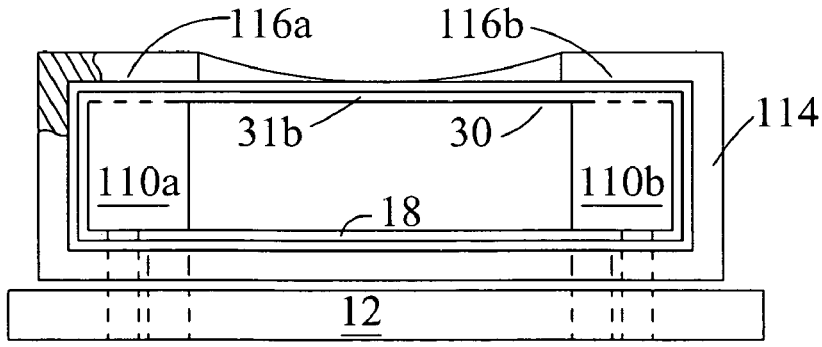
FIG. 8*k* is a bottom edge view of the combination of FIG. 8*j* with the insert removed.
Figure 81:
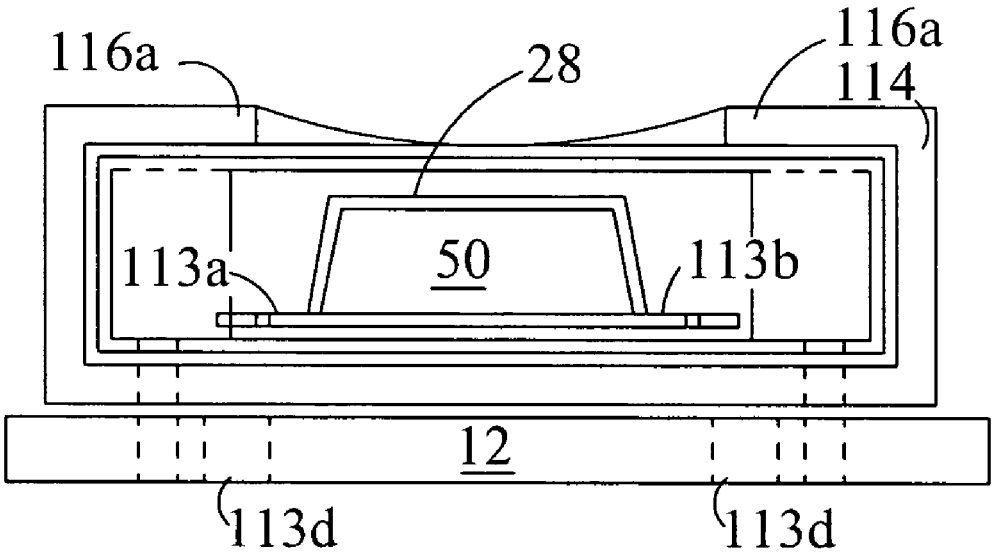

FIG. 8*k* is a bottom edge view of FIG. 8*j* showing the flap 30 region of the flap spring element 118 positioned under the left and right body shell flanges 116*a*, 116*b*. The left and right spring arms 110*a*, 110*b* rise on opposite sides from base 18 to opposite sides of flap 30. Empirical tests have shown that the body shell 114 must be securely fastened to the leather pad 12 to hold the assembly in an erect position to receive the serpentine clip 15. The leather pad can be made out of alternate materials such as reinforced fabric or polypropylene webbing. FIG. 1 shows that the leather pad 12 has belt loop slots 13*a*, 13*b*; however, a belt clip could be substituted for the slots.

FIG. 8*l* is a bottom or end view of FIG. 8*j* after the insert has been positioned on the base 18. The insert left and right mounting flanges 112*a*, 112*b* are on top of the base 18. The base 18 is on top of the body shell 114. Left and right spring arms 110*a*, 110*b* couple the base 18 to the flap 30. Insert channel 50 is in the insert 28. The bottom edge of the flap bottom edge 31*b* is seen as an edge.

Figure 9A:
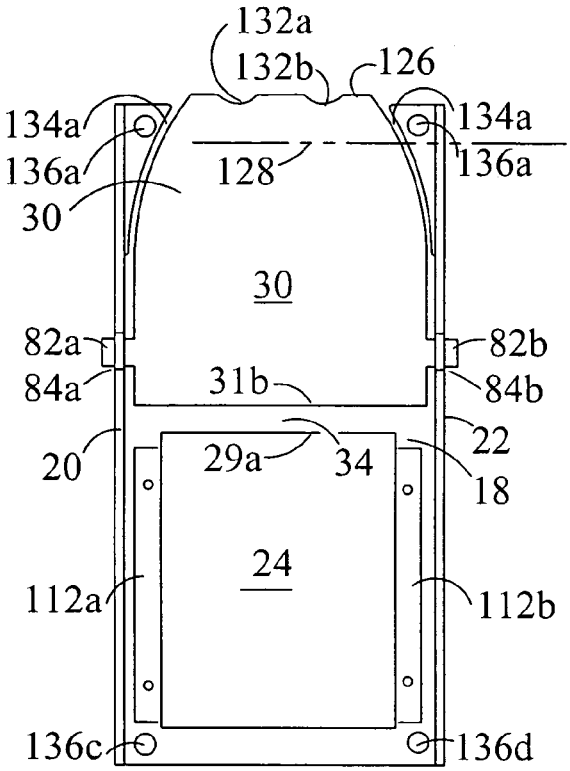
FIG. 9*a* is a plan view of a combined flap, spring and base, the insert being coupled to the base to form an insert channel above the base, in a third embodiment of the Manually Releasable Clip Holder.

FIG. 9*a* is a top plan view of another embodiment in which the flap, base and spring are combined to make an integral and homogeneous element. Flap 30 and the spring 126 are formed from a single sheet of material, typically spring steel, that also forms the base 18. The single sheet is also bent to form the sides of the body thereby eliminating the body shell component of FIGS. 8*e*–8*g*. The spring is formed by bending the spring material region 126 above phantom line 128 to a point determined empirically at which the flap 30 will have a range of movement within the elastic limit of the folded region at the top of the body leading from the top of the base to the flap. The combination of the flap and spring and the base into a single integral and homogeneous combination part eliminates the problem of flap pivot wear as discussed in connection with the embodiment of FIG. 1, and FIGS. 2*a*, 2*b*

Insert 24 in the embodiment of FIG. 9*a* is formed as a separate component with left and right mounting flanges 112*a*, 112*b* in the same manner that the insert in FIG. 8*l* was made. The left and right mounting flanges 112*a*, 112*b* are then spot welded 130 to the bottom or base of the body. In the alternative, four holes could be formed in mounting flanges 112*a* and 112*b* and used to attach insert 24 to body 18 if the hole pattern was replicated and matched in the body 18 and in the leather belt mount pad (not shown). If the hole patterns were matched, screws or rivets or bolts could be used to couple all three components together.

Figure 9B:
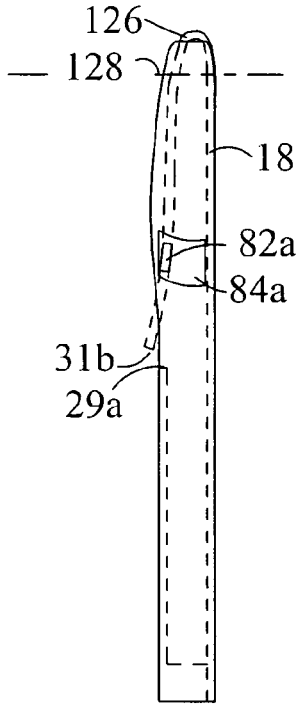
FIG. 9*b* is a side view of the Manually Releasable Clip Holder of FIG. 9*a*

FIG. 9*b* is a side view of the embodiment of FIG. 9*a* showing the flap bottom edge 31*b* protruding beyond the insert cover top edge 29*a*. The spring region 126 formed from bending the base blank appears above phantom line 128. It should be understood that the location of the bend and the spring region is determined empirically.

Figure 9C:
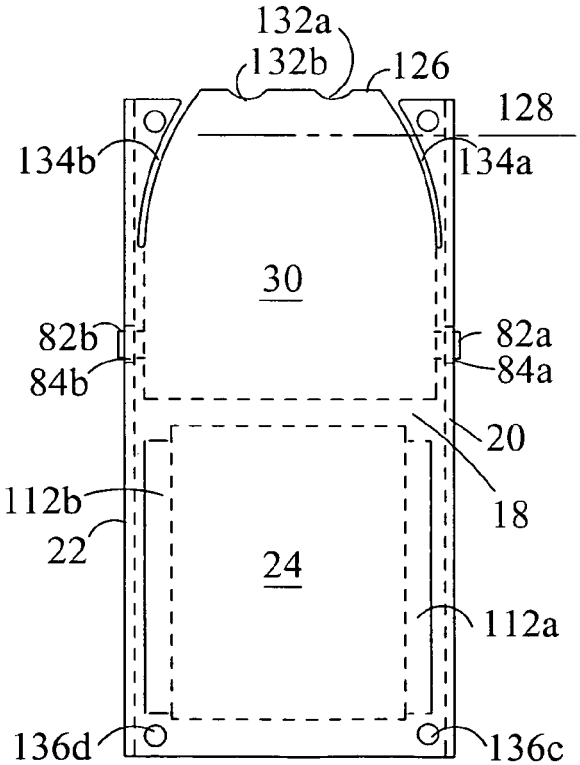
FIG. 9*c* is a bottom plan view of the Manually Releasable Clip Holder of FIG. 9*a;*

FIG. 9*c* shows the embodiment of FIG. 9*a* from the bottom. Left and right travel limit flanges 82*a*, 82*b* are provided as with the embodiment of FIGS. 1, 2*b* and 5*a*. Left and right travel limit apertures 84*a*, 84*b* are stamped in the body base plate and are understood to be necessary to receive the left and right travel limit flanges 82*a*, 82*b*.

Figure 9D:
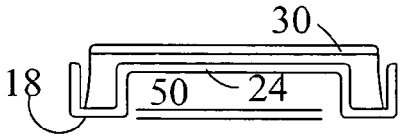
FIG. 9*d* is a bottom edge view the third embodiment of the Manually Releasable Clip Holder of FIG. 9*a* showing an alternative way of forming an insert from the body base material.

FIG. 9*d* shows another alternative embodiment in which the insert is formed by forcing metal up from the base region toward the plane of the flap leaving a void space under the metal that is forced up that forms the insert channel 50. A rectangular hole is stamped above the region of insert 24 that terminates below the start of base metal that supports an upper base region supporting the left and right sidewalls 20, 22 and leading to the region forming the spring region above phantom line 128. The region under the location of the insert could be stamped upward forming an insert cover 28 and an insert channel 50. The resulting part would have the insert, the base, the spring function and the flap formed out of a single integral, homogeneous sheet of material. The stamping and bending process of forming the combination would require that the body base plate be formed by stamping the body base from the back and stretching the metal.

The base plate metal is cut away to control the spring constant at region holes 132*a*, 132*b*. As the base plate metal is cut away enlarging the region holes 132*a*, 132*b* the remaining flex material is reduced thereby reducing the remaining spring constant of the flap and spring combination. Once the region holes are characterized for a flap and base design, region holes 132*a*, 132*b* are punched as the integral and homogeneous base plate and flap blank is formed. Mounting holes 136*a*–136*d* are pre-punched in the corners of the base plate to provide for screws or rivets for mounting the Manually Releasable Clip Holder 10 on the leather pad 12.

Figure 10A:
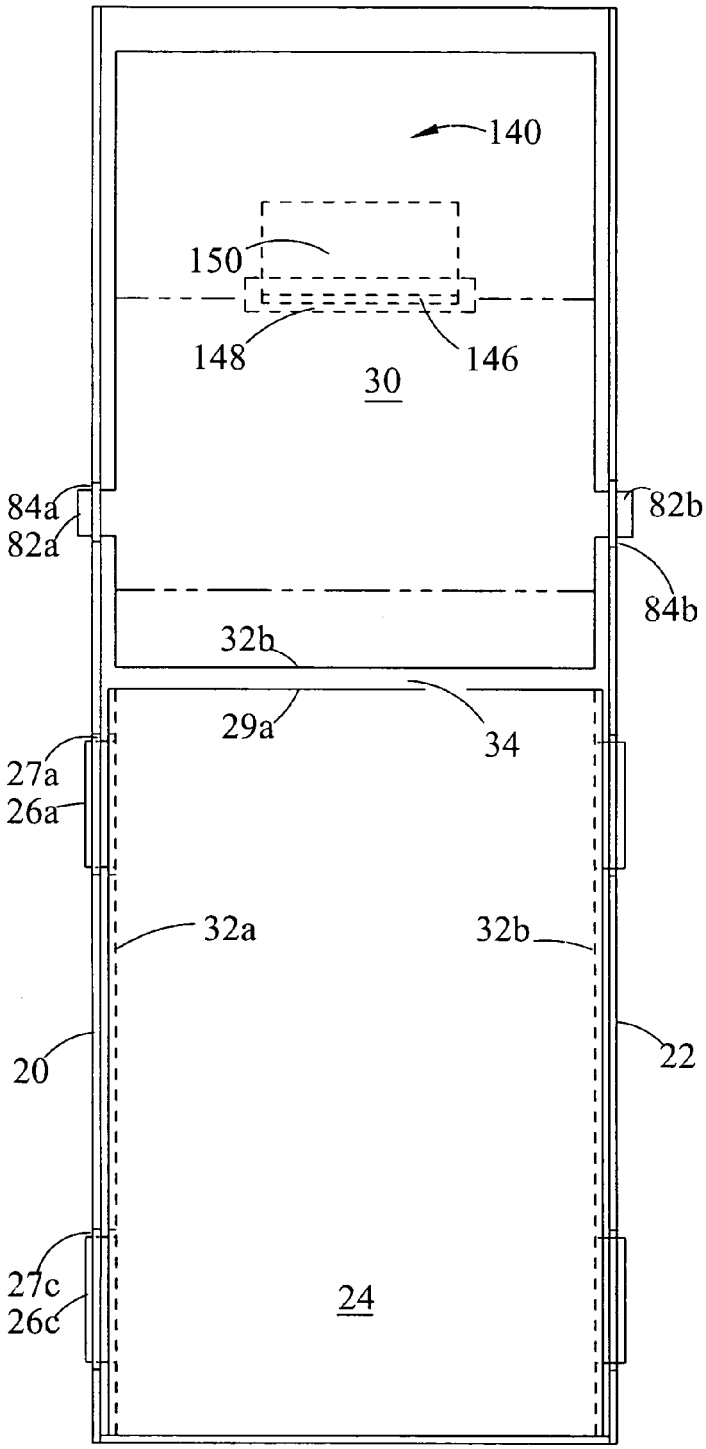
FIG. 10*a* is a plan view of a fourth embodiment of the Manually Releasable Tape Clip Holder using a combination integral and homogenous flap and spring supported from points above the insert aperture, the insert being a separate part.

FIG. 10*a* is a plan view of an embodiment that is similar to the embodiment of FIGS. 2*a* and 2*b*, and it also eliminates the flap pivot and any possible flap pivot wear, by combining the flap and the spring into a single integral homogeneous part. The base and insert remain separate parts.

Figure 10B:
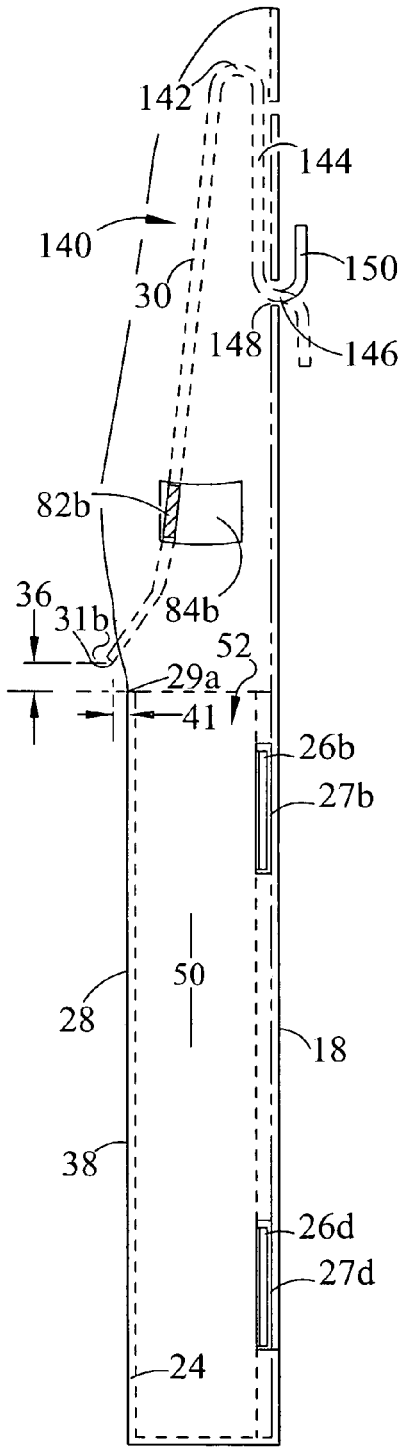
FIG. 10*b* is a side view of the third embodiment of the Manually Releasable Clip Holder of FIG. 10*a;*

FIG. 10*b* shows the embodiment in a side view in which the shape of the combination flap and spring component 140 is depicted in phantom. The spring component in the combination has a top U-bend 142 at the top end of the flap region 30. The metal continues from the return of the top U-bend 142 along a foot flange region 144 to the start of a hook U-Bend region 146 which after passing through a base aperture 148, extends along a hook flange region 150. The hook flange region 150 is tightly coupled to the base of the body by tightening the bend radius of the hook U-bend 146. It should be understood that the hook flange region 150 could be formed to pass through the aperture 148 and then be formed to pass downward instead of upward as shown. The direction of the hook flange region would thereby be in the direction of insert channel 50 and its form would be that of an s-shaped hook instead of the u-shaped hook that is shown. The remaining features shown in FIGS. 10*a* and 10*b* are the same as those shown and explained in connection with FIGS. 2*a* and 2*b*.

While certain specific relationships materials and other parameters have been detailed in the above description of preferred embodiments, those can be varied, where suitable, with similar results. Other applications and variations of the present invention will occur to those skilled in the art upon reading the present disclosure. Those variations are also intended to be included within the scope of this invention as defined in the appended claims.

APPENDIX

LIST OF TERMS AND THEIR RELATED REFERENCE NUMBERS

Manually Releasable Clip Holder 10
a leather pad 12
belt loop holes 13*a*, 13*b*
retractable tape measure 14
a serpentine clip 15
body 16
abase 18
The left sidewall 20
The right side walls 22
a left sidewall 20
a right side wall 22
insert 24
the sheet metal pattern 25
four insert flanges 26*a*–26*d*
four receiving body flange slots 27*a*–27*d*
insert cover 28
insert cover top edge 29*a*
insert cover bottom edge 29*b*
a flap 30
a flap top edge 31*a*
a flap bottom edge 31*b*
the insert left wall 32*a*
insert right wall 32*b*
clearance window 34
window height 36
insert channel aperture 37
insert cover outer surface 38
an insert cover outer surface to flap bottom edge clearance distance 41
flap pivot flanges 42*a*, 42*b*
insert cover outer surface 43
a spring base end 45
a spring tang end 46
a toe end 46
a receiving fold 48
an insert channel 50
insert channel aperture 52
a spring 54
a top and bottom spring body base slot 56*a*, 56*b*
spring tang reach 59
flat spring 61
base holes 62*a*–62*d*
body top tab area 66
body fold line 68
Left and right side wall flap flange receiving holes 70*a*, 70*b* (flap pivot)
insert fold lines 71*a* and 71*b*
the sheet metal pattern 72
an insert cover area 74
an insert left wall area 76
an insert right wall area 78
left and right flap travel limit flanges 82*a* and 82*b*
left and right flap travel limit apertures 84*a*, 84*b*
a shoulder 86
a serpentine clip channel 88
a mounting plate side 90.
the right side of the retractable tape measure housing 91
a serpentine side of serpentine clip 92
schematic representation of tape measure 14 or other items or housing 91, block 94
four flange areas 102*a*–102*d*
left and right spring arms 110*a*, 110*b*
insert left and right mounting flanges 112*a*, 112*b*
left and right body shell flanges 116*a*, 116*b*
flap base spring element 118,
body shell opening 120,
rivet holes 113*a*–113*d*
spring material 126,
phantom line 128
spring constant control regions 132*a*, 132*b*
base wall clearance regions 134
mounting holes 136*a*–136*d*
flap and spring combination, 140
top U-bend 142,
foot flange region 144,
hook U-Bend 146
base aperture 148
hook flange region 150
combination body and insert 154
left mounting flange 158
right mounting flange 160

What is claimed is:

1. A manually releasable clip holder for receiving, holding and manually releasing a serpentine clip comprising:

a base-plate, the base plate being substantially flat, an insert coupled to the base-plate, the insert having an insert cover positioned over the base plate to form an insert channel over the base plate, the insert cover having a top edge, a bottom edge, and an inner surface and an outer surface, the insert channel having an insert channel entrance adjacent the insert cover top edge, a flap pivotally coupled to the base plate, the flap having top and bottom edges, a spring coupled to restore the flap to a predetermined restored position with the flap bottom edge positioned above the insert cover top edge with the flap bottom edge extended toward the insert channel and protruding beyond the insert cover outer surface by a predetermined insert cover outer surface to flap bottom edge clearance distance that is greater than zero.

2. The manually releasable clip holder of claim 1 wherein the base-plate has a top end and a bottom end, the top end having a receiving fold formed from a first flange region, the flap having top edge positioned in the receiving fold of the base plate, the spring coupled between the base-plate and the flap being formed and coupled to the base plate to restore the flap to its restored position and to hold the flap top edge in the receiving fold.

3. The manually releasable clip holder of claim 1 further comprising:

a body, the base-plate forming the floor of the body, the base-plate having a top end, a bottom end and a longitudinal axis, the insert having a longitudinal axis aligned with the longitudinal axis of the base plate, the flap being formed from a thin walled plate material having a left edge, a right edge, a top edge, and a longitudinal axis parallel to the longitudinal axis of the base plate, the flap being formed to have left and right flap pivot flanges extending outward from the left edge and the right edge transverse to the longitudinal axis from root locations near the top edge, the body having a left sidewall and a right sidewall, the left sidewall and the right sidewall being positioned to be substantially normal to the base plate, each sidewall having a respective flap flange receiving hole formed therein to receive a corresponding left and right flap pivot flange to permit the flap to pivot on the left and right flap pivot flanges.

4. The manually releasable clip holder of claim 1 wherein:

the base-plate is substantially rectangular, formed from thin walled material and having a top end, a bottom end, a left edge and a right edge, a left sidewall being formed on the left edge, a right sidewall being formed on the right edge, each respective sidewall extending vertically from the base-plate, the flap being formed from a thin walled material and having a left edge, a right edge, and wherein the flap further comprises:

a rod coupled to the flap near to the top end, the rod extending past the flap's left edge and the right edge parallel to the top bottom edge and forming a flap pivot axel having a left and a right axel end, the left sidewall and the right sidewall each having a hole formed therein to receive the corresponding left and right axel end, the flap thereby using the rod as a pivot axel for the flap.

5. The manually releasable clip holder of claim 1 further comprising:

a body, the base-plate forming the floor of the body, the body being formed from a thin wall plate material, the base-plate having a top end, a bottom end and a longitudinal axis, the insert having a longitudinal axis aligned with the longitudinal axis of the base plate, and a leather pad having at least one belt loop, the body being coupled to the leather pad.

6. The manually releasable clip holder of claim 1 where in the means for limiting the distance that the flap bottom edge moves beyond the outer surface of the insert further comprises:

a flap having left and right travel limit flanges, and wherein the body left sidewall and right sidewall have corresponding left and right travel limit apertures, the flap left and right travel limit flanges being positioned in the body's corresponding left and right travel limit apertures to limit the travel of the flap when the flap is in the restored position.

7. A manually releasable clip holder for receiving and holding a serpentine clip coupled to a tool or object, the manually releasable clip holder comprising:

a body having a base-plate positioned between a left sidewall and right sidewall, the base-plate being substantially rectangular and having a top end, a bottom end and a longitudinal axis passing between the left sidewall and the right sidewall, the left and right sidewall extending vertically from the base-plate, an insert coupled to the base plate between the left and right sidewalls, the insert having an insert left sidewall coupled to the body, an insert right sidewall coupled to the body, the insert left and insert right sidewalls supporting an insert cover positioned between the insert left sidewall and insert right sidewall, the insert cover having an outer surface and an inner surface, the insert cover inner surface facing the base-plate, the insert cover having a top edge and a bottom edge, the insert left sidewall, insert right sidewall and insert cover inner surface forming an insert channel having a channel aperture, the insert cover top edge forming a portion of the perimeter of the insert channel aperture, a flap having a top edge, a bottom edge, a left edge, a right edge and a longitudinal axis parallel to the longitudinal axis of the base plate, the flap being pivotally coupled on a pivot axis to the body, the pivot axis being located to position the flap bottom edge above the insert channel top edge, a spring coupled to the body and to the flap to restore the flap to a restored positioned with the bottom edge positioned above the channel aperture, a separation between the flap bottom edge in the restored position and the insert cover top edge forming a window to the channel aperture.

8. The manually releasable clip holder of claim 7 wherein the base-plate has:

a receiving fold formed from a first flange region, the flap top edge being positioned into the receiving fold of the base plate, the spring coupled between the base-plate and the flap being formed to hold the flap top edge in the receiving fold.

9. The manually releasable clip holder of claim 7 wherein the body and the base-plate forming the floor of the body, are formed from a thin wall plate material, and wherein the insert has a longitudinal axis that is aligned with the longitudinal axis of the base plate, the flap being formed from a thin walled plate material, the flap being formed to have left and right flap pivot flanges extending outward from the left edge and the right edge transverse to the longitudinal axis of the flap and from root locations near the top edge, the left sidewall and a right sidewall of the body each having a flap flange receiving hole formed therein to receive a respective left pivot flange and right flap pivot flanges to permit the flap to pivot on the left and right flap pivot flanges.

10. The manually releasable clip holder of claim 7 wherein the flap further comprises:

left and right travel limit flanges, and wherein the body left sidewall and right sidewall have corresponding left and right travel limit apertures, the flap left and right travel limit flanges being positioned in the body's corresponding left and right travel limit apertures.

11. The manually releasable clip holder of claim 7 further comprising:

a flap travel limit means for limiting the pivotal travel of the flap to stop the insert cover bottom edge at a restored limit position, the flap bottom edge protruding a predetermined clearance distance beyond the insert cover outer surface, the clearance distance being greater than zero, and a leather pad having at least one belt loop, the body being coupled to the leather pad.

12. A manually releasable clip holder for receiving, holding and manually releasing a serpentine clip comprising:

a base-plate, the base plate being substantially flat, an insert coupled to the base-plate, the insert having an insert cover positioned over the base plate to form an insert channel over the base plate, the insert cover having a top edge, a bottom edge, an inner and an outer surface, the insert channel having an insert channel entrance adjacent the insert cover top edge, a flap and spring combination (30), (126), (140), the flap and spring combination being formed from a single homogeneous piece of material and having a flap portion (30) pivotally coupled to the base plate, the flap portion (30) having a bottom edge (31*b*), the flap and spring combination having a spring portion coupled to restore the flap portion (30) to a predetermined restored position with the flap bottom edge (31*b*) extended toward the insert channel, the bottom edge being positioned above the insert cover top edge with the flap bottom edge (31*b*) protruding beyond the insert cover outer surface (38) by a predetermined insert cover outer surface to flap bottom edge clearance distance (41) that is greater than zero.

13. The manually releasable clip holder of claim 12 wherein the top U-bend (142), foot flange region (144), hook shoulder (146) and hook flange (150) are formed to function as a spring between the base-plate (16) and the flap portion (30) of the flap and spring combination (140) to provide a restoring force to return the flap to a predetermined restored position with a separation between the flap bottom edge in the restored position and the insert cover top edge (29*a*), wherein a means for limiting the distance that the flap bottom edge moves beyond the outer surface of the insert cove comprises:

a flap portion (30) having left and right travel limit flanges (82*a*), (82*b*), and wherein the body left sidewall (20) and right sidewall (22) have corresponding left and right travel limit apertures (84*a*), (84*b*), the flap left and right travel limit flanges (82*a*), (82*b*) being positioned in the body's corresponding left and right travel limit apertures.

14. The manually releasable clip holder of claim 12 further comprising:

means for limiting the distance that the flap bottom edge (31*b*) travels beyond the insert cover outer surface (38) to establish an insert cover outer surface to flap bottom edge clearance distance (41) when the flap portion (30) of the flap and spring combination (140) is in the restored position.

15. The manually releasable clip holder for receiving and holding the serpentine clip of claim (12) comprising:

a body (16) having a base-plate region (18) with a longitudinal axis that is shaped and bent to form a left body sidewall (20) and a right body sidewall (22) normal to the base-plate region (18), the base plate region having a top end, an insert (24) of thin walled material having the insert left sidewall (32*a*), an insert right sidewall (32*b*), and an insert cover (28), the insert cover having an outer surface (38), an inner surface and a top edge (29*a*), each insert sidewall being coupled to the base-plate between the left and right body sidewalls (20), (22), the insert left sidewall (32*a*) and insert right sidewall (32*b*) supporting the insert cover (28) above the base-plate (16), the insert left sidewall top edge and right sidewall top edge, the insert cover top edge (29*a*) forming a channel aperture (52) at the entrance to an insert channel (50*b*) between the insert channel left and right sidewalls (32*a*), (32*b*) and above the floor of the base-plate (16), the flap and spring combination (140) having a flap region that extends away from the flap bottom edge (31*b*) to a top U-Bend (142), the top U-bend (142) being followed by a foot flange region (144) formed to extend in a reverse direction toward the flap bottom edge (31*b*), the foot flange region (144) terminating in a hook shoulder (146), the hook shoulder being formed to extend into a hook flange region (150) in the direction of away from the flap bottom edge, the body base-plate (18) having a base aperture (148) positioned above the flap lower edge (31*b*), the flap region (30), top U-bend (142), foot flange region (144), hook shoulder (146) and hook flange (150) being formed to permit the hook flange to be inserted through the base aperture (148), each region and shoulder being formed and coupled to the base plate to return the flap bottom edge (31*b*) to the predetermined position protruding beyond the insert cover outer surface (38) by a predetermined insert cover outer surface to flap bottom edge clearance distance (41 that is greater than zero, the position the flap lower edge (31*b*) above the insert cover top edge (29*a*) forming a window with a window height (36) leading to the channel aperture (52), the flap (30) portion of the flap and spring combination (140) being displaced toward the base-plate (16) in response to a light manual force or in response to a light deflection force from a serpentine clip to admit the clip into the insert channel (50) via the insert aperture (52).

* * * * *